US011394108B2

(12) United States Patent
Sone

(10) Patent No.: US 11,394,108 B2
(45) Date of Patent: Jul. 19, 2022

(54) ANTENNA DEVICE

(71) Applicant: YOKOWO CO., LTD., Tokyo (JP)

(72) Inventor: Takayuki Sone, Tomioka (JP)

(73) Assignee: Yokowo Co., Ltd., Tokyo (JP)

( * ) Notice: Subject to any disclaimer, the term of this patent is extended or adjusted under 35 U.S.C. 154(b) by 38 days.

(21) Appl. No.: 16/302,351

(22) PCT Filed: Jun. 16, 2017

(86) PCT No.: PCT/JP2017/022413
§ 371 (c)(1),
(2) Date: Nov. 16, 2018

(87) PCT Pub. No.: WO2018/055854
PCT Pub. Date: Mar. 29, 2018

(65) Prior Publication Data

US 2019/0190136 A1 Jun. 20, 2019

(30) Foreign Application Priority Data

Sep. 22, 2016 (JP) ..... JP2016-184956

(51) Int. Cl.
*H01Q 9/28* (2006.01)
*H01Q 9/04* (2006.01)
(Continued)

(52) U.S. Cl.
CPC ..... *H01Q 1/3233* (2013.01); *H01Q 1/32* (2013.01); *H01Q 1/48* (2013.01); *H01Q 5/40* (2015.01);
(Continued)

(58) Field of Classification Search
CPC .... H01Q 1/3233; H01Q 9/045; H01Q 9/0421; H01Q 9/285; H01Q 1/48; H01Q 1/32;
(Continued)

(56) References Cited

U.S. PATENT DOCUMENTS 8,063,827 B2 * 11/2011 Hotta ..... H01Q 9/38 343/700 MS
8,830,135 B2 * 9/2014 Dean ..... H01Q 9/285 343/795
(Continued)

FOREIGN PATENT DOCUMENTS

JP 2005-117363 A 4/2005
JP 2009-077250 A 4/2009
(Continued)

OTHER PUBLICATIONS

Partial supplementary European Search Report dated Sep. 10, 2019, issued in corresponding European Patent Application No. 17852635.6.
(Continued)

*Primary Examiner* — Hai V Tran
(74) *Attorney, Agent, or Firm* — Morgan, Lewis & Bockius LLP

(57) ABSTRACT

The antenna device includes: a broadband antenna based on a bow-tie antenna including a first plate-like metal and a second plate-like metal which extend in opposite directions to each other with respect to a feeding point; and a patch antenna provided on a second portion which is bent substantially at a right angle from a first portion of the first plate-like metal which lies near the feeding point. The second portion performs as a ground plate of the patch antenna. A portion including the patch antenna is accommodated in a radome.

15 Claims, 17 Drawing Sheets

(51) Int. Cl.

| | |
|---|---|
| ***H01Q 1/32*** | (2006.01) |
| ***H01Q 21/28*** | (2006.01) |
| ***H01Q 13/08*** | (2006.01) |
| ***H01Q 9/26*** | (2006.01) |
| ***H01Q 1/48*** | (2006.01) |
| ***H01Q 5/40*** | (2015.01) |
| ***H01Q 25/00*** | (2006.01) |
| *H01Q 1/42* | (2006.01) |

(52) U.S. Cl.
CPC ..... *H01Q 9/04* (2013.01); *H01Q 9/045* (2013.01); *H01Q 9/0421* (2013.01); *H01Q 9/0435* (2013.01); *H01Q 9/26* (2013.01); *H01Q 9/28* (2013.01); *H01Q 9/285* (2013.01); *H01Q 13/085* (2013.01); *H01Q 21/28* (2013.01); *H01Q 25/00* (2013.01); *H01Q 1/42* (2013.01)

(58) Field of Classification Search
CPC ..... H01Q 9/0435; H01Q 9/04; H01Q 9/28; H01Q 25/00
USPC ..... 343/711
See application file for complete search history.

(56) References Cited

U.S. PATENT DOCUMENTS

| | | | | |
|---|---|---|---|---|
| 9,899,741 | B2 * | 2/2018 | Roulston | H01Q 13/18 |
| 9,941,588 | B2 * | 4/2018 | Desclos | H01Q 9/06 |
| 10,389,031 | B2 * | 8/2019 | Sanpo | H01Q 21/28 |
| 2003/0043084 | A1 * | 3/2003 | Egashira | H01Q 5/378 343/767 |
| 2006/0164305 | A1 | 7/2006 | Chen et al. | |
| 2006/0181475 | A1 | 8/2006 | Kwon et al. | |
| 2007/0046554 | A1 * | 3/2007 | Fukuchi | H01Q 1/22 343/767 |
| 2007/0200762 | A1 * | 8/2007 | Frank | H01Q 9/40 343/700 MS |
| 2009/0167622 | A1 * | 7/2009 | Yanagisawa | H01Q 7/00 343/772 |
| 2009/0224991 | A1 * | 9/2009 | Rowson | H01Q 9/0421 343/747 |
| 2010/0321273 | A1 | 12/2010 | Kuramoto | |
| 2011/0279338 | A1 | 11/2011 | Myszne et al. | |
| 2013/0214982 | A1 | 8/2013 | Dean et al. | |

FOREIGN PATENT DOCUMENTS

| | | | |
|---|---|---|---|
| JP | 2009-194832 | A | 8/2009 |
| JP | 2011-066837 | A | 3/2011 |
| JP | 2011-193432 | A | 9/2011 |

OTHER PUBLICATIONS

Extended European Search Report (EESR) dated Nov. 21, 2019, issued in corresponding European Patent Application No. 17852635.6.

Search Report (with partial translation) and Written Opinion dated Aug. 29, 2017, issued in corresponding International Application No. PCT/JP2017/022413.

Notice of Reasons for Refusal dated Apr. 13, 2021, issued in corresponding Japanese Patent Application No. 2018-164426.

Extended European Search Report dated Oct. 8, 2021, issued in corresponding European U.S. Appl. No. 21179743 6.

* cited by examiner

CONFIGURATION 1

CONFIGURATION 2

CONFIGURATION 3

CONFIGURATION 3

CONFIGURATION 3-1

CONFIGURATION 3-2

ANTENNA DEVICE

TECHNICAL FIELD

The present invention relates to an antenna device including a broadband antenna based on a bow-tie antenna.

BACKGROUND

In recent years, there have been growing demands of placing a broadband antenna for telematics (hereinafter, referred to as "TEL") and an antenna for Global Navigation Satellite System (GNSS) on vehicles.

PRIOR ART LITERATURE

Patent Literature

[Patent Literature 1] JP-A-2011-193432

Patent Literature 1 discloses an example of a bow-tie antenna having a configuration designed to realize miniaturization of the antenna.

SUMMARY OF THE INVENTION

When the TEL antenna and the GNSS antenna are composite, there has conventionally been problems in that broadening the band of the TEL antenna and controlling the directional gain of the TEL antenna are difficult. Additionally, the improvement in broadband characteristics of the TEL antenna has not yet been studied sufficiently.

The present invention has been made based on the recognition of these situations, and an object of the present invention is to provide a broadband antenna device for use over a broad frequency band.

Problem to be Solved by the Invention

A first aspect of the present invention is a composite antenna device. This composite antenna device includes a broadband antenna based on a bow-tie antenna including a first conductor element and a second conductor element which extend in opposite directions to each other with respect to a feeding point, and a patch antenna provided on the first conductor element or the second conductor element.

In the first aspect, the first conductor element or the second conductor element may perform as a ground of the patch antenna.

In the first aspect, assuming that orthogonal three axes are referred to as an X axis, a Y axis and a Z axis, the first conductor element may have a portion extending in a positive Z direction from the feeding point and being substantially parallel to an X-Z plane, and the second conductor element may have a portion extending in a negative Z direction from the feeding point and being substantially parallel to the X-Z plane, and at least one of the first conductor element and the second conductor element may have a first portion lying near the feeding point and a second portion extending from the first portion so as to have an area being non-parallel to the first portion. Additionally, the second portion may extend from the first portion so as to be substantially parallel to an X-Y plane or to form an angle equal to or smaller than 90 degrees between the first portion and the second portion.

The first conductor element may have a first portion lying near the feeding point, the first portion extending in the positive Z direction from the feeding point and being substantially parallel to the X-Z plane, and a second portion extending substantially parallel to the X-Y plane from the first portion, and the patch antenna may be provided on the second portion of the first conductor element.

Ribs may be formed in both side positions of the patch antenna so as to rise in the positive Z direction from the second portion of the first conductor element, and a cutaway may be provided at portions of the ribs opposing both side surfaces of the patch antenna.

In the first aspect, at least one of the first conductor element and the second conductor element may have a curved contour projecting towards the feeding point so as to narrow areas of opposite gaps defined between the first conductor element and the second conductor element.

In the first aspect, the composite antenna device may include a coaxial cable which feeds the broadband antenna, another coaxial cable which feeds the patch antenna, and a magnetic core which is provided at an outer circumference of the coaxial cables.

A broadband antenna circuit board may be interposed between the broadband antenna and the coaxial cable which feeds the broadband antenna, and a ground of the broadband antenna circuit board may be overlapped on the first conductor element so as to be integrally connected with the first conductor element.

A second aspect of the present invention is an antenna device. This antenna device includes a broadband antenna based on a bow-tie antenna including a first conductor element and a second conductor element which extend in opposite directions to each other with respect to a feeding point, and at least one of the first conductor element and the second conductor element has a curved contour projecting towards the feeding point so as to narrow areas of opposite gaps defined between the first conductor element and the second conductor element.

In the second aspect, when orthogonal three axes are referred to as an X axis, a Y axis and a Z axis, the first conductor element may have a portion extending in a positive Z direction from the feeding point and being substantially parallel to an X-Z plane, and the second conductor element may have a portion extending in a negative Z direction from the feeding point and being substantially parallel to the X-Z plane, and at least one of the first conductor element and the second conductor element may have a first portion lying near the feeding point and a second portion extending from the first portion so as to have an area being non-parallel to the first portion. Additionally, the second portion may extend from the first portion so as to be substantially parallel to an X-Y plane or to form an angle equal to or smaller than 90 degrees between the first portion and the second portion.

The antenna device may have a third portion extending from the second portion so as to have an area being non-parallel to the second portion.

In the second aspect, a broadband antenna circuit board may be interposed between the broadband antenna and the coaxial cable which feeds the broadband antenna, and a ground of the broadband antenna circuit board may be overlapped on the first conductor element or the second conductor element so as to be integrally connected with the first conductor element or the second conductor element.

An arbitrary combination of the constituent elements that have been described above and a method or a system resulting from changing the expressions or representations made in the present invention will also be effective as aspects of the present invention.

Advantageous Effects of the Invention

According to the present invention, the broadband antenna device including the bow-tie antenna, which can be used as a TEL antenna to be set on a vehicle, for example, can be realized. Additionally, it is possible to make the antenna device composite by providing the patch antenna, which is applicable for use as a GNSS antenna, in a part of the broadband antenna based on the bow-tie antenna.

MODE FOR CARRYING OUT THE INVENTION

Figure 1:
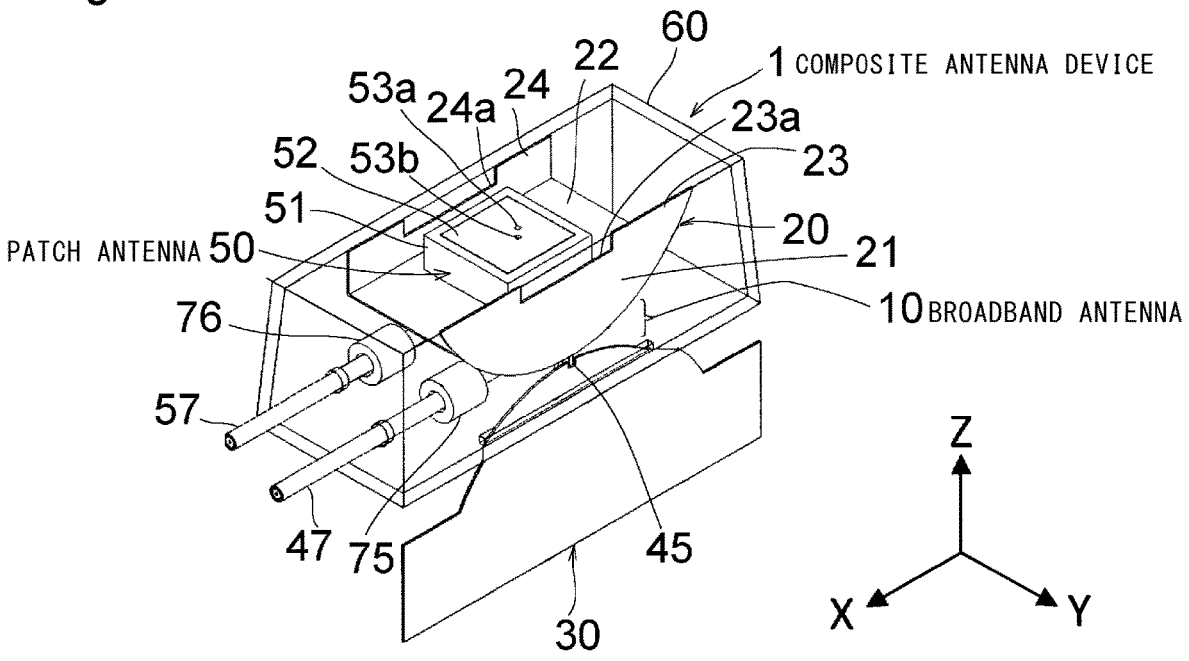
FIG. 1 is a front perspective view of a first embodiment of an antenna device according to the present invention as seen down obliquely from a top view point.

Hereinafter, referring to drawings, preferred embodiments of the present invention will be described in detail. Same reference numerals will be given to same or equivalent constituent elements, members and processes shown in the drawings, whereby the duplication of the same or similar descriptions will be omitted as required. These embodiments are not intended to limit the invention but to describe examples of the invention. Thus, all characteristics described in the embodiments or combinations thereof do not always constitute essential matters of the invention.

Figure 11:
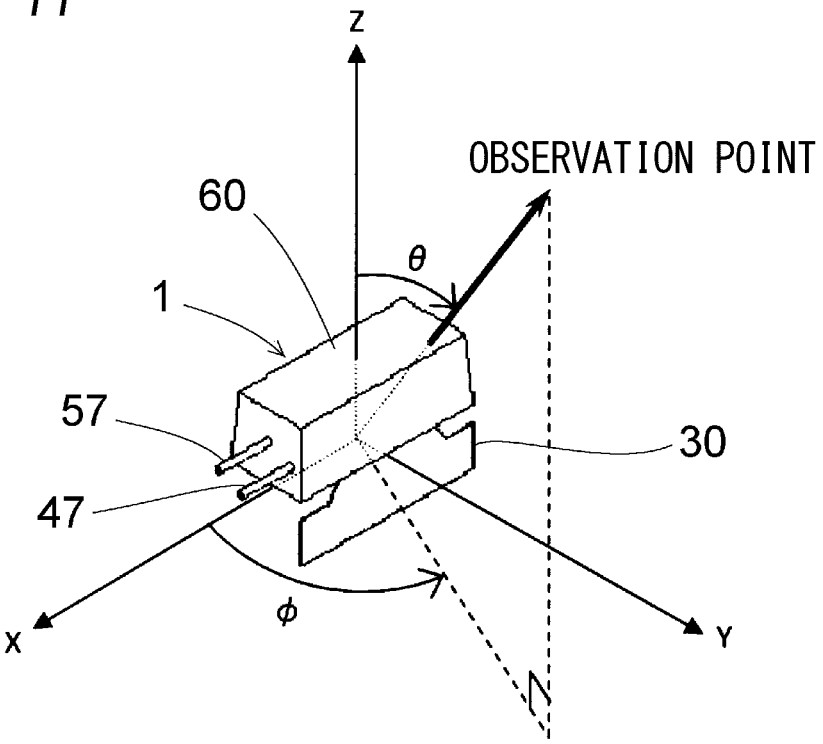
FIG. 11 is an arrangement diagram when measuring antenna gains or the like in the first embodiment.

FIGS. 1 to 8 show a composite antenna device 1, which is an embodiment of an antenna device according to the present invention. In this composite antenna device 1, a patch antenna 50 performing as a GNSS antenna is provided on a conductor element (an antenna element) of a TEL broadband antenna 10 which is based on a bow-tie antenna. As a matter of convenience in description, as shown in FIGS. 1 and 11, three orthogonal axes which are an X axis, a Y axis and a Z axis are defined with respect to the composite antenna device 1. In addition, in FIG. 11, the Z axis and an observation point form an angle of θ°. A straight line connecting an origin and an intersection point between a perpendicular drawn down from the observation point to an X-Y plane and the X-Y plane and the X axis form an azimuthal angle 4). Here, as a matter of convenience in description, the description may be made, from time to time, based on understanding: the positive Z direction corresponds to an upward direction; and the negative Z direction corresponds to a downward direction.

The TEL broadband antenna 10 based on the bow-tie antenna includes a first plate-like metal 20 performing as a first conductor element, a second plate-like metal 30 performing as a second conductor element, and a TEL antenna circuit board 40 performing as a broadband antenna circuit board. The first plate-like metal 20 and the second plate-like metal 30 extend in opposite directions to each other with respect to a feeding point 45, which will be described later.

The first plate-like metal 20 has a first portion 21 and a second portion 22. The first portion 21 extends in the positive Z direction from the feeding point 45, is substantially parallel to an X-Z plane, and has a shape approximate to a triangular shape one of vertexes of which is the feeding point 45, a semi-circular shape or a semi-elliptic shape. The second portion 22 is bent from the first portion 21 to be substantially parallel to the X-Y plane. Ribs 23, 24 are formed to rise in the positive Z direction in positions at both sides of the second portion 22 which are spaced apart from each other in the Y-axis direction. The second portion 22 is bent substantially perpendicular to the first portion from a position which is one level lower than an upper edge of the first portion 21, and the rib 23 is made up of an upper edge portion of the first portion 21.

The second plate-like metal 30 has a shape which extends in the negative Z direction from the feeding point 45 and which is substantially parallel to the X-Z plane. The shape of the second plate-like metal 30 is approximate to a triangular shape one of vertexes of which is the feeding point 45, a semi-circular shape or a semi-elliptic shape.

The first plate-like metal 20 and the second plate-like metal 30 of the TEL broadband antenna 10 are fixed to a radome 60 which is made of a resin enabling radio wave to permeate it. A TEL antenna circuit board 40 shown in FIG. 9A is connected to feeding sides of the first plate-like metal 20 and the second plate-like metal 30, and the first plate-like metal 20 and the TEL antenna circuit board 40 are accommodated within the radome 60.

Figure 9A:
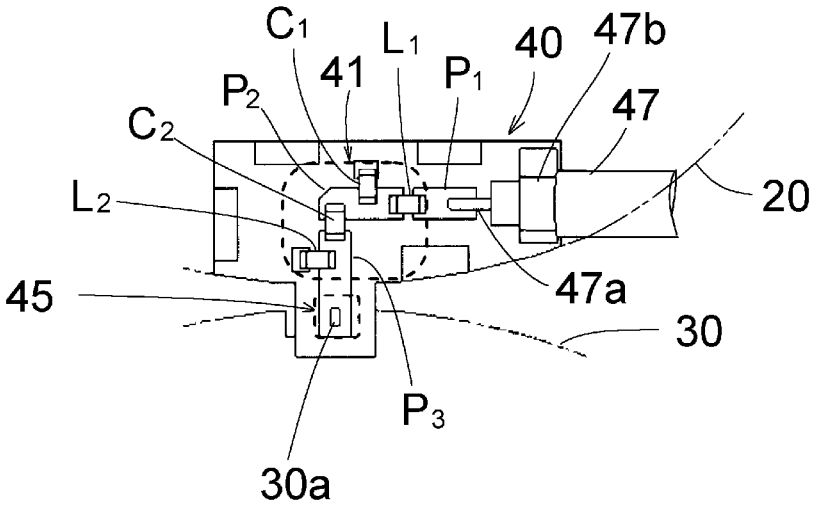
FIG. 9A is a rear view of a TEL antenna circuit board in the first embodiment.

As shown in FIG. 9A, the TEL antenna circuit board 40 for impedance matching includes a matching circuit 41 which has strip-shaped conductor patterns $P_1$, $P_2$, $P_3$ (a rear surface of the circuit board constitutes a ground pattern, so as to make up a microstripline), chip capacitors $C_1$, $C_2$, and chip coils $L_1$, $L_2$ which are provided on the circuit board 40. The chip coil $L_1$ is connected between the strip-shaped conductor patterns $P_1$, $P_2$, and the chip capacitor $C_2$ is connected between the belt-shaped conductor patterns $P_2$, $P_3$. The rear surface of the surface of the TEL antenna circuit board 40 shown in FIG. 9A constitutes the ground pattern. The chip capacitor $C_1$ is connected between the strip-shaped conductor pattern $P_2$ and the ground pattern, and the chip coil $L_2$ is connected between the strip-shaped conductor pattern $P_3$ and the ground pattern.

Figure 9B:
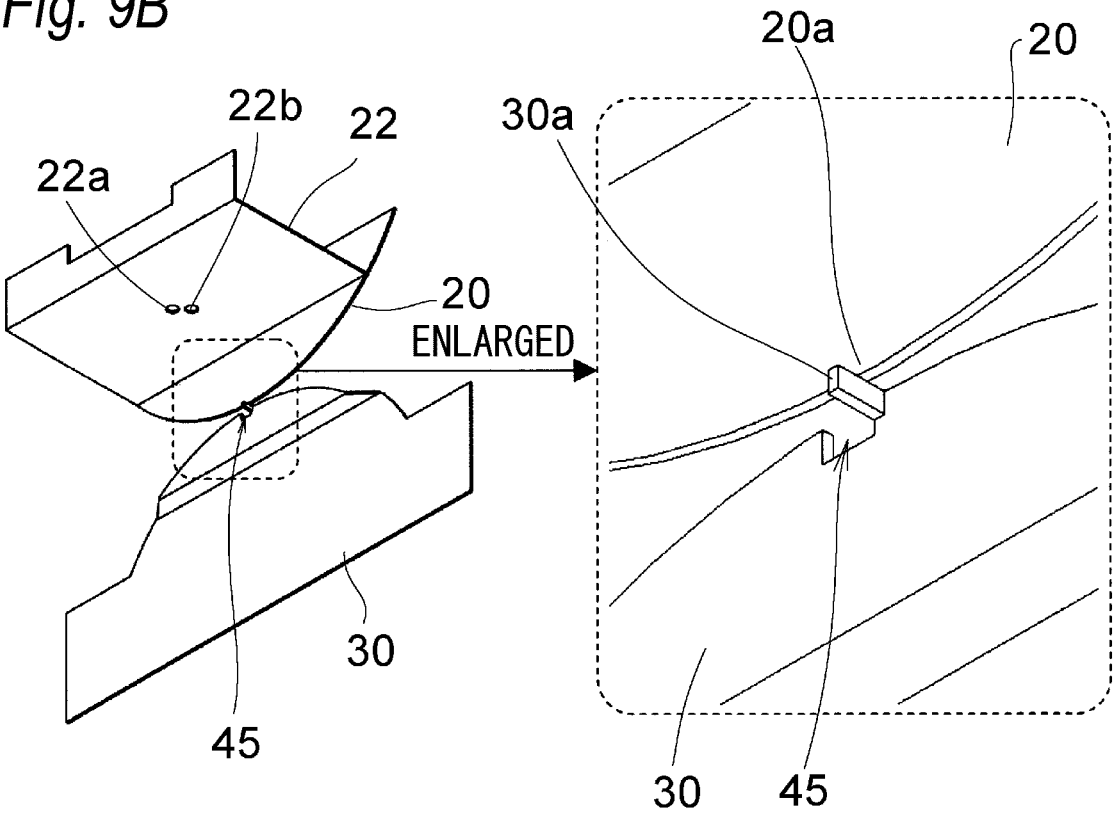
FIG. 9B is an enlarged perspective view showing a portion of a first plate-like metal and a second plate-like metal of a TEL antenna of the first embodiment including a feeding point.

A center conductor 47*a* of a coaxial cable 47, which is a feeding line configured to feed the TEL broadband antenna 10, is connected to the strip-shaped conductor pattern $P_1$, and an outer conductor 47*b* of the coaxial cable 47 is connected to the ground pattern. That is, the coaxial cable 47 is connected to a feed-side end portion 20*a* of the first plate-like metal 20 and a feed-side end portion 30*a* of the second plate-like metal 30 via the matching circuit 41. The feed-side end portion 20*a* of the first plate-like metal 20 shown in FIG. 9B is electrically connected to the ground pattern on the rear surface of the TEL antenna circuit board 40 so as to overlap the ground pattern. The feed-side end portion 30*a* of the second plate-like metal 30 is connected to the strip-shaped conductor pattern $P_3$ shown in FIG. 9A. Here, the connecting point between the feed-side end portion 30*a* of the second plate-like metal 30 and the strip-shaped conductor pattern $P_3$ shown in FIG. 9A constitutes the feeding point 45, the center conductor 47*a* of the coaxial cable 47 is electrically connected to the second plate-like metal 30, and the outer conductor 47*b* is electrically connected to the first plate-like metal 20.

The patch antenna 50, which performs as the GNSS antenna, is provided on the second portion 22 of the first plate-like metal 20 which is parallel to the X-Y plane. The patch antenna 50 has a patch antenna element 51 in which a square conductor 52 is provided on an upper surface of a dielectric and a GNSS antenna circuit board 55 which is provided on a lower surface of the second portion 22. The second portion 22 constitutes a ground conductor plate on a bottom surface side of the patch antenna element 51. These constituent elements of the patch antenna 50 are accommodated in the radome 60. Cutaways 23*a*, 24*a* are respectively formed in the ribs 23, 24 provided at both the sides of the second portion 22. The cutaways 23*a*, 24*a* oppose both side surfaces of the patch antenna element 51 which are orthogonal to the Y-axis direction so as not to prevent the passage of a magnetic flux of a radio wave which the patch antenna 50 receives.

Figure 10:
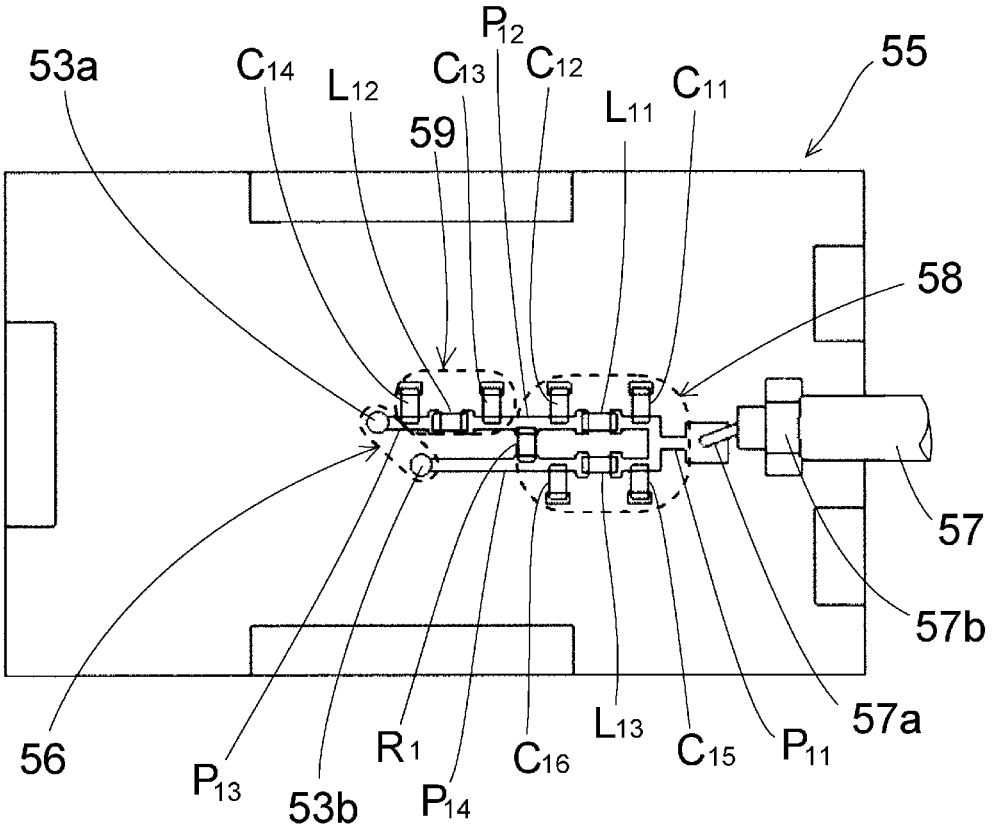
FIG. 10 is a bottom view of a GNSS antenna circuit board of the first embodiment.

As shown in FIG. 10, the GNSS antenna circuit board 55 includes strip-shaped conductor patterns $P_{11}$, $P_{12}$, $P_{13}$, $P_{14}$ (a rear surface of the circuit board constitutes a ground pattern, so as to make up a microstripline), a chip coil $L_{11}$ connecting one of branched patterns of the strip-shaped conductor pattern $P_{11}$ and the strip-shaped conductor pattern $P_{12}$, a chip coil $L_{12}$ connecting together the strip-shaped conductor patterns $P_{12}$ and $P_{13}$, a chip coil $L_{13}$ connecting the other of the branched patterns of the strip-shaped conductor pattern $P_{11}$ and the strip-shaped conductor pattern $P_{14}$, chip capacitors $C_{11}$, $C_{12}$, $C_{13}$, $C_{14}$, $C_{15}$, $C_{16}$, and a chip resistance $R_1$ between the strip-shaped conductor patterns $P_{12}$, $P_{14}$. The rear surface of the surface of the GNSS antenna circuit board 55 shown in FIG. 10 constitutes the ground pattern. The chip capacitor $C_{11}$ is connected between the one of the branched patterns of the strip-shaped conductor pattern $P_{11}$ and the ground pattern. The chip capacitors $C_{12}$, $C_{13}$ are connected between the belt-shaped conductor pattern $P_{12}$ and the ground pattern. The chip capacitor $C_{14}$ is connected between the strip-shaped conductor pattern $P_{13}$ and the ground pattern. The chip capacitor $C_{15}$ is connected between the other of the branched patterns of the strip-shaped conductor pattern $P_{11}$ and the ground pattern. The chip capacitor $C_{16}$ is connected between the strip-shaped conductor pattern $P_{14}$ and the ground pattern. A transmission line (a portion including the chip coil $L_{11}$ and the chip capacitors $C_{11}$, $C_{12}$) of the one of the branched patterns of the strip-shaped conductor pattern $P_{11}$ which is branched into the two conductor patterns and a transmission line (a portion including the chip coil $L_{13}$ and the chip capacitors $C_{15}$, $C_{16}$) of the other of the branched patterns of the strip-shaped conductor pattern $P_{11}$ make up a coupling circuit 58. The chip coil $L_{12}$, the strip-shaped conductor pattern $P_{13}$ and the chip capacitors $C_{13}$, $C_{14}$ configure a phase adjusting circuit 59. Two feeding pins 53*a*, 53*b* connected to the square conductor 52 of the patch antenna element 51 for receiving a circularly polarized wave are provided so as to penetrate the patch antenna element 51 and through holes 22*a*, 22*b* (FIG. 9B) of the second portion 22, and to penetrate the GNSS antenna circuit board 55. The feeding pins 53*a*, 53*b* are connected to the strip-shaped conductor patterns $P_{13}$, $P_{14}$, respectively, at a feeding portion 56. In addition, the ground pattern on the rear surface of the GNSS antenna circuit board 55 is overlapped on the second portion of the first plate-like metal 20 to be electrically connected to the second portion, whereby the first plate-like metal 20 performs as a ground of the patch antenna 50. Although a band-pass filter or a low noise amplifying module may be provided further on the GNSS antenna circuit board 55, they are omitted in this embodiment.

A center conductor 57*a* of a coaxial cable 57, which performs as a feeding line for feeding the patch antenna 50, is connected to a pattern of the strip-shaped conductor pattern $P_{11}$ which is disposed on a side thereof where the strip-shaped conductor pattern $P_{11}$ is not branched, and an outer conductor 57*b* of the coaxial cable 57 is connected to the ground pattern. That is, the coaxial cable 57 is electrically connected to the two feeding pins 53*a*, 53*b* on the patch antenna 50 via the coupling circuit 58 and the phase adjusting circuit 59 which are disposed on the GNSS antenna circuit board 55. The two feeding pins 53*a*, 53*b* are connected to the square conductor 52 of the patch antenna element 51.

A conductor shield case 70 is disposed and fixed to the bottom surface of the GNSS antenna circuit board 55 so as to cover the lower surface of the GNSS antenna circuit board 55 to prevent unnecessary connections.

Magnetic cores 75, 76 (for example, ferrite cores) are provided on outer circumferences of the coaxial cables 47, 57, respectively (the coaxial cables 47, 57 penetrate through the magnetic cores 75, 76, respectively), in order to suppress that a leak current flows to outer conductors of the coaxial cables 47, 57. The magnetic cores 75, 76 are also preferably accommodated in the radome 60.

The TEL broadband antenna 10 based on the bow-tie antenna, which is provided in the composite antenna device 1, performs both a transmitting operation and a receiving operation. Here, it is described a case that the TEL broadband antenna 10 performs as a transmission antenna. Firstly, a high-frequency signal is propagated through the coaxial cable 47, then, is propagated through the microstrip line on the TEL antenna circuit board 40 and is finally fed to the first plate-like metal 20 and the second plate-like metal 30 of the TEL broadband antenna 10 so as to be emitted to an external space as a radio wave.

The patch antenna 50 performing as the GNSS antenna, which is provided in the composite antenna device 1, performs a receiving operation. Firstly, the patch antenna 50 receives a corresponding satellite wave. Next, the high-frequency signal propagated from the patch antenna 50 to the GNSS antenna circuit board 55 is propagated through the phase adjusting circuit 59 and the coupling circuit 58 (and such circuits as a band-pass filter and a low noise amplifying module which are provided as required), and is finally propagated from the GNSS antenna circuit board 55 to the coaxial cable 57, whereby the high-frequency signal is output to an external unit.

Figure 12:
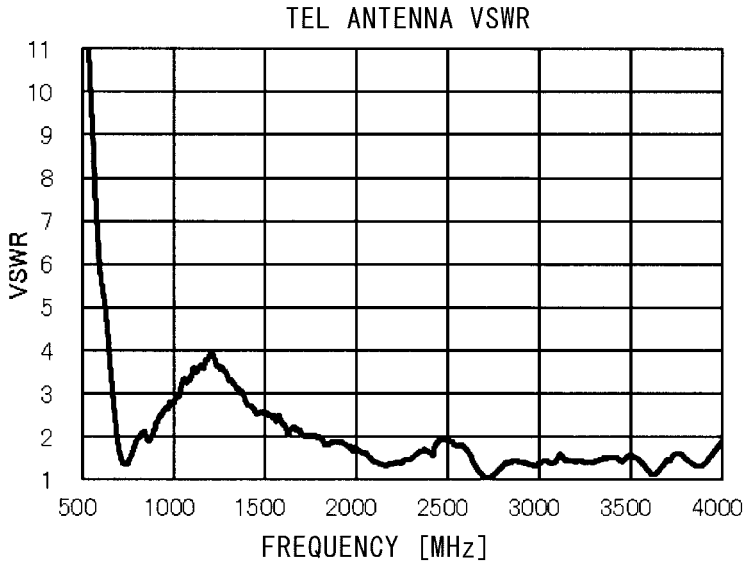
FIG. 12 is a graph showing frequency characteristics of a VSWR, which is antenna characteristics of the TEL antenna in the first embodiment.

FIG. 12 shows frequency characteristics of a VSWR of the TEL broadband antenna 10 based on the bow-tie antenna according to the present embodiment, and a sufficiently low VSWR can be realized over a broad frequency band (699 to 3800 MHz) of the Long Term Evolution (LTE). This result is obtained in a condition that a coaxial cable of a characteristic impedance of 50Ω is connected.

Figure 13:
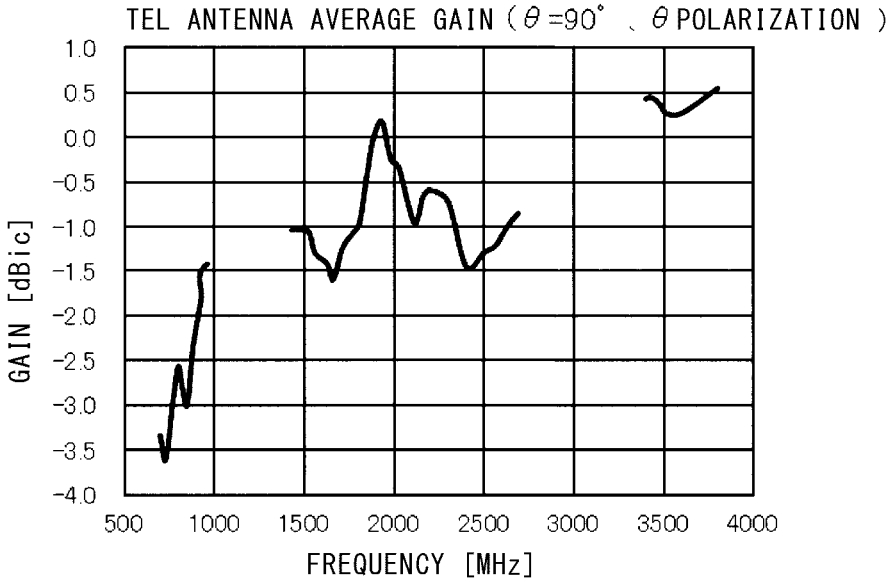
FIG. 13 is a graph showing frequency characteristics of an average gain (dBic) of θ polarization (vertical polarization) at θ=90° (horizontal plane), which is antenna characteristics of the TEL antenna in the first embodiment.

When the composite antenna device 1 is disposed as shown in FIG. 11 and the positive Z direction of the Z axis is referred to as a zenith direction, the TEL broadband antenna 10 has a high average gain of θ polarization at θ=90° (horizontal plane) as shown in FIG. 13. In addition, the gain deviation becomes small at the azimuthal angle ϕ.

FIG. 13 shows frequency characteristics of the average gain (dBic) of θ polarization (vertical polarization) at θ=90° (horizontal plane) of the TEL broadband antenna 10, and a sufficient average gain can be ensured over a desired frequency band of the LTE. The average gain (dBic) is an average value of the gain when the azimuthal angle ϕ shown in FIG. 11 is changed from 0° to 360°.

Figure 14:
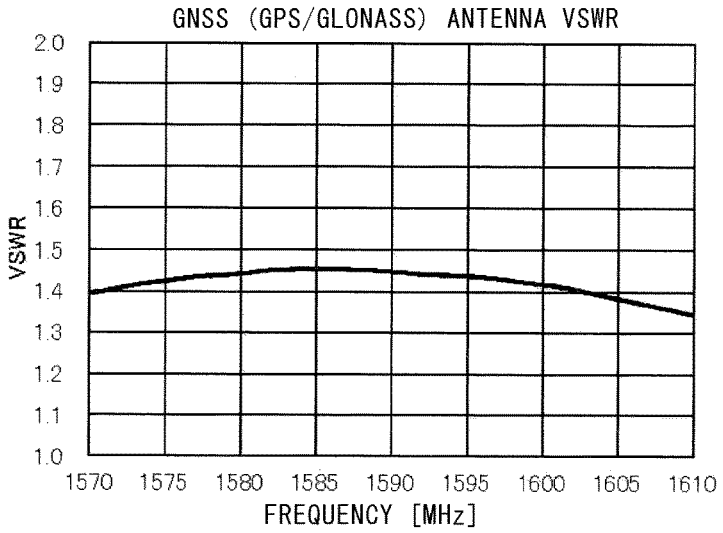
FIG. 14 is a graph showing frequency characteristics of a VSWR, which is antenna characteristics of a GNSS antenna excluding a low noise amplifying module in the first embodiment.

FIG. 14 shows frequency characteristics of a VSWR of the patch antenna 50 which performs as the GNSS antenna excluding a low noise amplifying module according to the present embodiment, and a sufficiently low VSWR can be realized over the frequency bands of GPS (Global Positioning System: a frequency band of 1575.397 to 1576.443 MHz) and GLONASS (Global Navigation Satellite System: a frequency band of 1597.807 to 1605.6305 MHz). This result is obtained in a condition that a coaxial cable of a characteristic impedance of 50Ω is connected.

Figure 15:
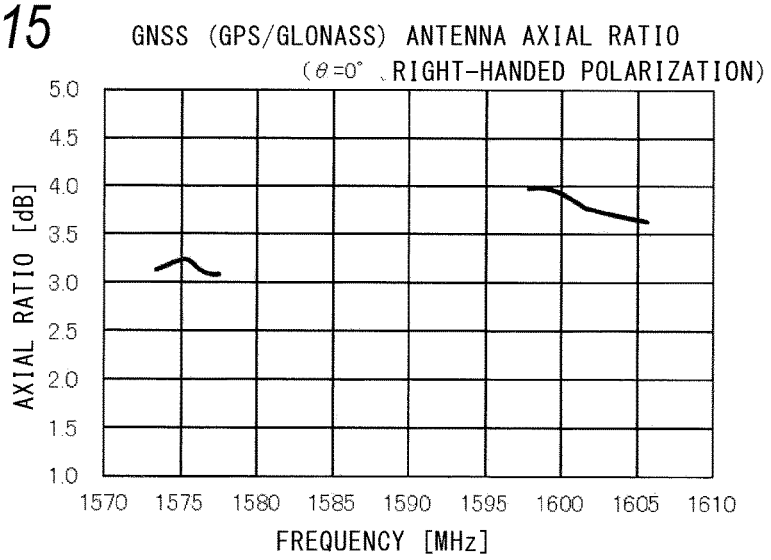
FIG. 15 is a graph showing frequency characteristics of an axial ratio (dB) of a right-handed polarized wave at θ=0° in the same GNSS antenna.
Figure 16:
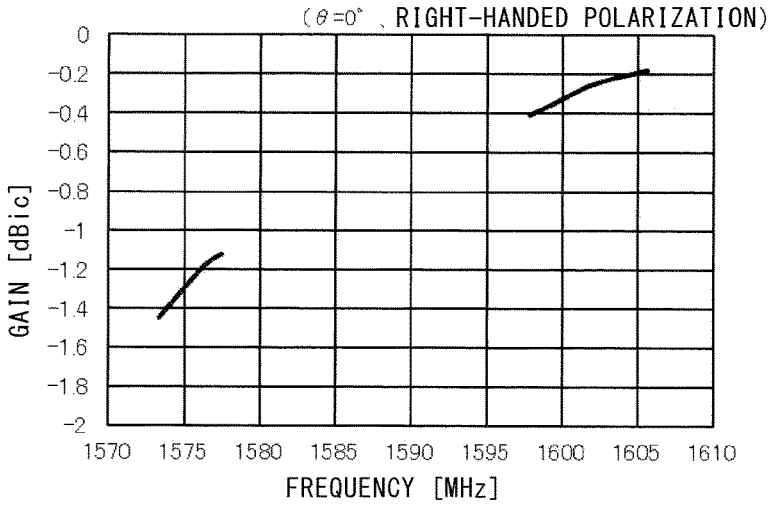
FIG. 16 is a graph showing frequency characteristics of a gain (dBic) of a right-handed polarized wave at θ=0° in the same GNSS antenna.

When the composite antenna device 1 is disposed as shown in FIG. 11 and the positive Z direction of the Z axis is referred to as the zenith direction, the patch antenna 50 performing as the GNSS antenna has a high gain of a right-handed polarized wave in the zenith direction as shown in FIGS. 15 and 16.

FIG. 15 shows frequency characteristics of an axial ratio (dB) of a right-handed polarized wave at θ=0° of the patch antenna 50 performing as the GNSS antenna shown in the present embodiment, and a sufficiently good axial ratio is obtained over the frequency bands of GPS and GLONASS.

FIG. 16 shows frequency characteristics of a gain (dBic) of the right-handed polarized wave at θ=0° of the patch antenna 50 performing as the GNSS antenna shown in the present embodiment, and a sufficiently good gain is obtained over the frequency bands of GPS and GLONASS.

According to the present embodiment, the following advantageous effects can be provided.

(1) The TEL broadband antenna 10 is configured based on the bow-tie antenna which includes the first plate-like metal 20 performing as the first conductor element and the second plate-like metal 30 performing as the second conductor element, the first plate-like metal 20 and the second plate-like metal 30 extending in the opposite directions to each other with respect to the feeding point. The patch antenna 50 performing as the GNSS antenna is provided on the first plate-like metal 20, and the first plate-like metal 20 performs as the ground of the patch antenna 50. Thus, the composite antenna device is obtained which is small in size and able to be used over the broad frequency band.

(2) The first plate-like metal 20 of the TEL broadband antenna 10 includes the first portion 21 at the feed side and the second portion 22 which is bent at right angles from the first portion 21, and the patch antenna 50 is provided on the second portion 22. Thus, when main parts of the first plate-like metal 20 and the second plate-like metal 30 of the TEL broadband antenna 10 are disposed vertically (with the positive Z direction of the Z axis directed towards the zenith) so as to transmit and receive a vertically polarized wave, the upper surface (the surface on which the square conductor 52 is disposed) of the GNSS patch antenna 50 can be directed towards the θ=0° direction which is suitable for receiving a radio wave from a satellite.

In other words, with the TEL broadband antenna 10 based on the bow-tie antenna, the average gain of θ polarization (vertically polarization) is high at θ=90° (horizontal plane), and the gain deviation is small at the azimuthal angle ϕ. Thus, the TEL broadband antenna 10 for a vehicle works advantageously in communication with a TEL base station in a state where it is not known that a direction of the TEL base station exists in the azimuthal angle ϕ shown in FIG. 11. Additionally, with the patch antenna 50 performing as the GNSS antenna, the gain of a right-handed polarized wave is high in the zenith direction. Thus, the patch antenna 50 works advantageously in communication using a satellite wave.

(3) The ribs 23, 24 are formed to rise in the positive Z direction on the second portion 22 of the first plate-like metal 20 in the positions at both the sides of the second portion 22 which are spaced away from each other in the Y-axis direction of the patch antenna 50. This can increase the overall area of the first plate-like metal 20, so as to contribute to improvement in sensitivity. Additionally, the cutaways 23*a*, 24*a* are provided in the portions of the ribs 23, 24 which oppose both the side surfaces of the patch antenna 50 orthogonal to the Y-axis direction. This can prevent the passage of a magnetic flux of a radio wave received by the patch antenna 50 from being interrupted, thereby making it possible to avoid a reduction in performance of the patch antenna 50. Additionally, by adjusting the size of the cutaways 23*a*, 24*a*, the resonance frequency of the patch antenna 50 can be adjusted.

(4) The magnetic cores 75, 76 are provided respectively on the outer circumferences of the coaxial cables 47, 57 which respectively feed the TEL broadband antenna 10 and the patch antenna 50, thereby it is possible to prevent that a leak current flows to the outer conductors of the coaxial cables 47, 57.

Figure 2:
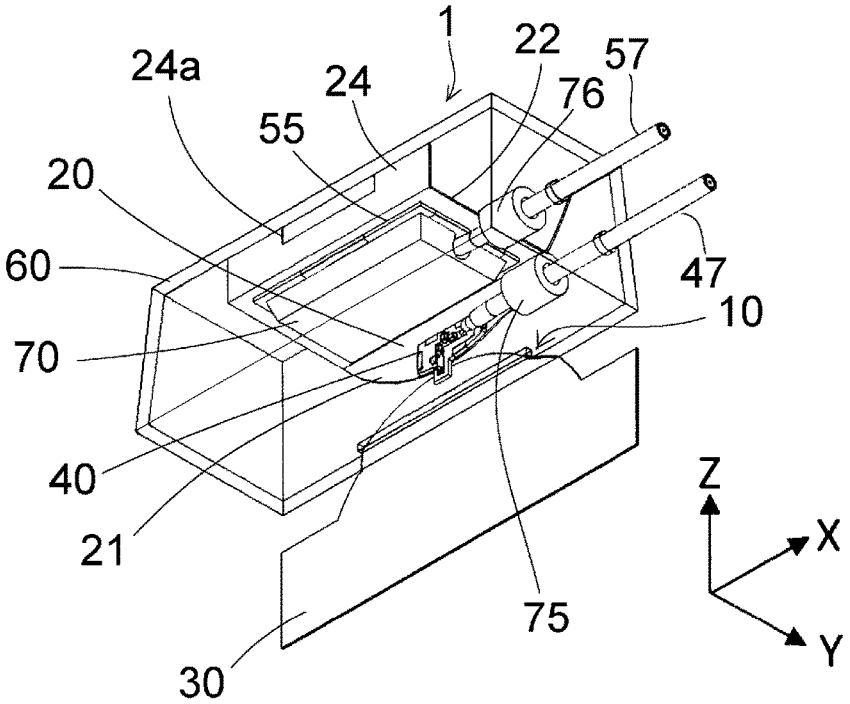
FIG. 2 is a rear perspective view of the same embodiment as seen up from a bottom view point.
Figure 3:
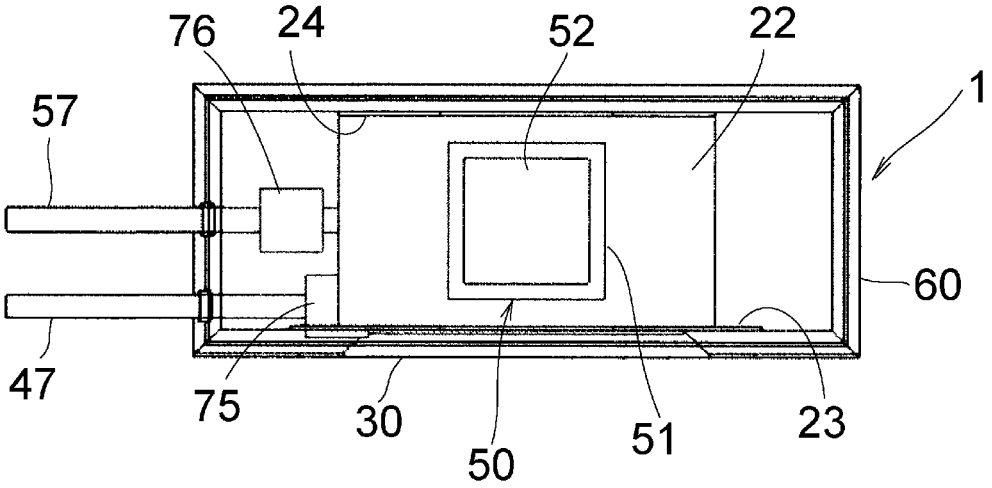
FIG. 3 is a plan view of the first embodiment.
Figure 4:
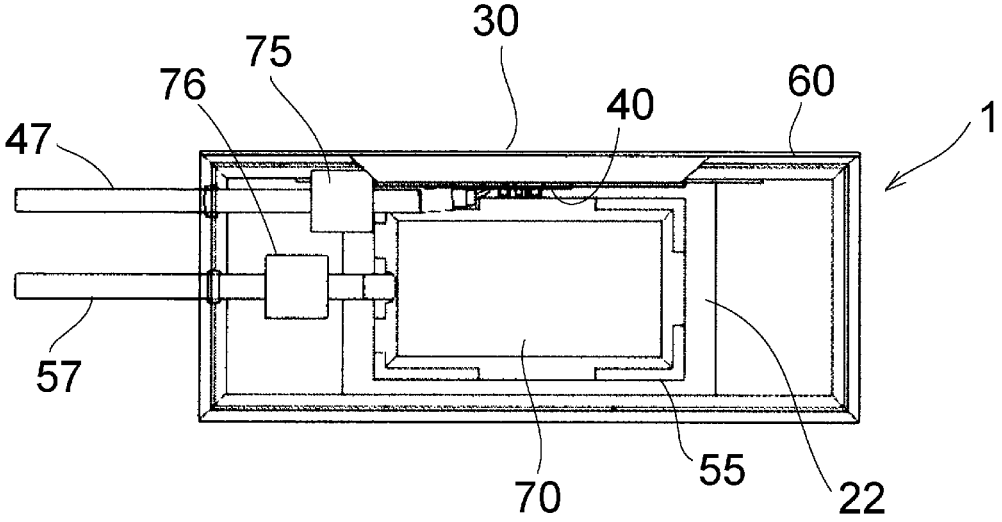
FIG. 4 is a bottom view of the same embodiment.
Figure 5:
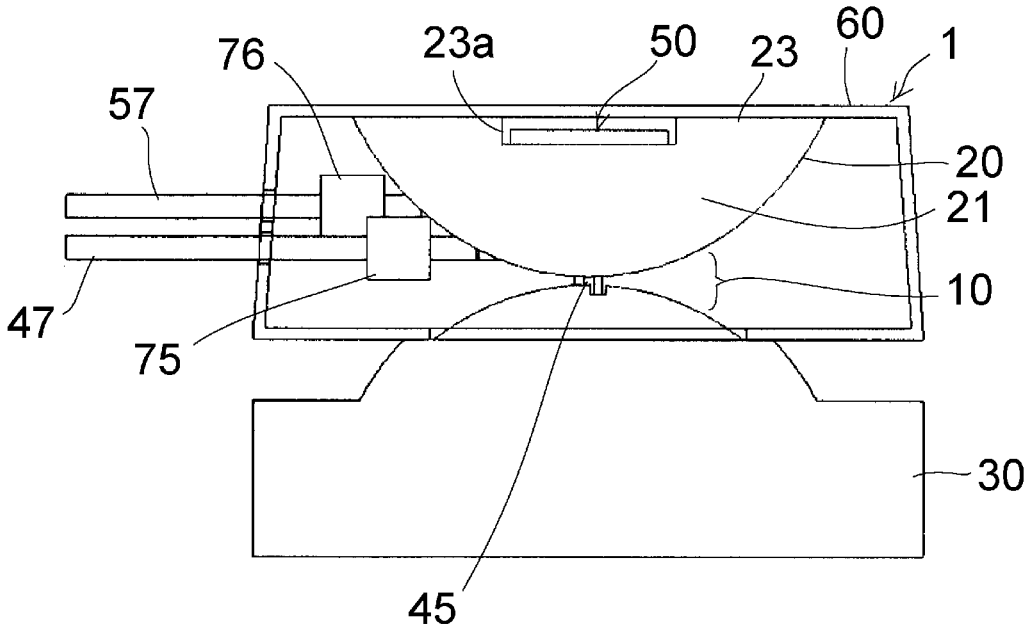
FIG. 5 is a front view of the same embodiment.
Figure 6:
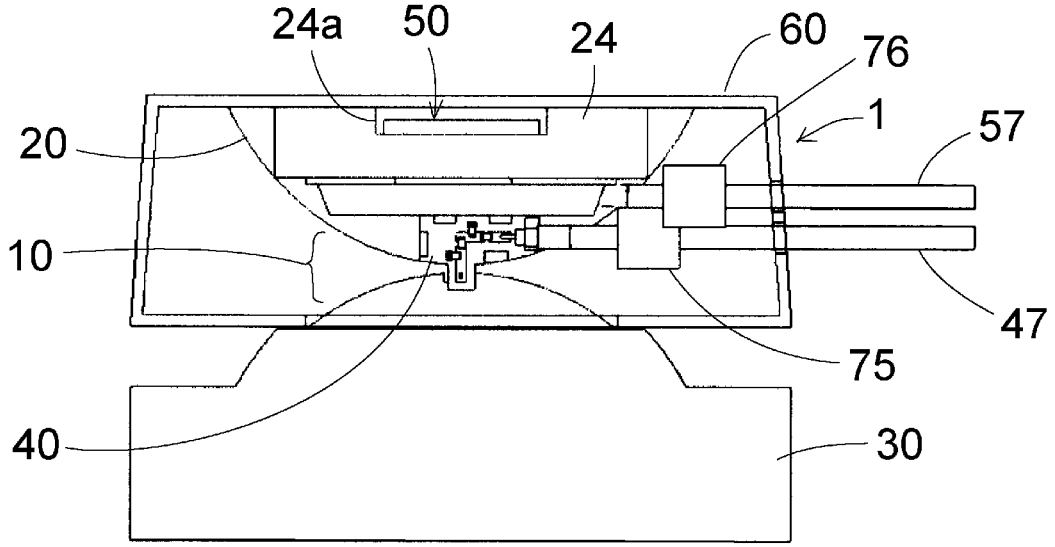
FIG. 6 is a rear view of the same embodiment.
Figure 7:
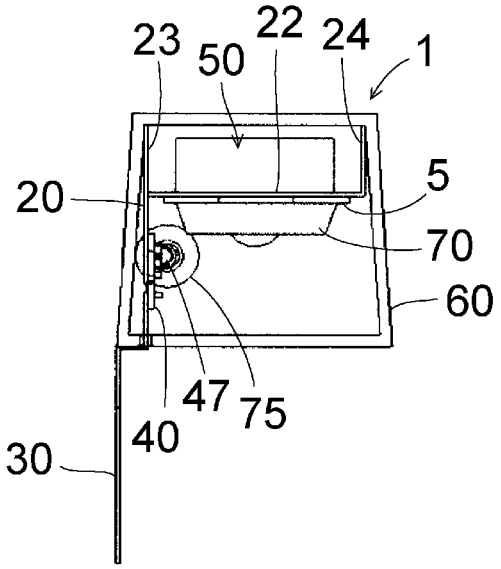
FIG. 7 is a right side view of the same embodiment.
Figure 8:
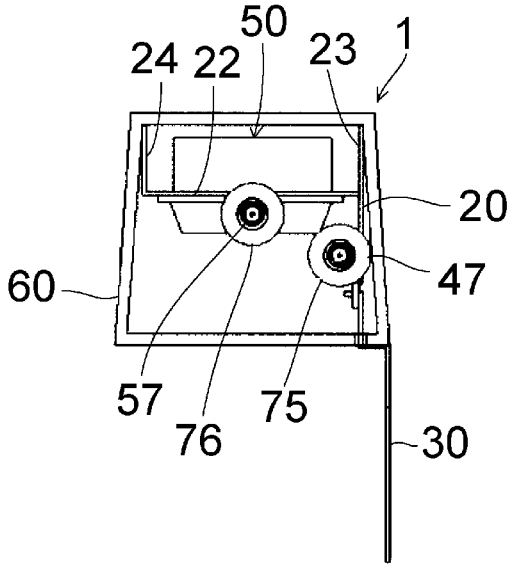
FIG. 8 is a left side view of the same embodiment.

(5) As is seen from FIGS. 2 and 6, the first plate-like metal 20 of the TEL broadband antenna 10 overlaps the TEL antenna circuit board 40, and the first plate-like metal 20 is connected to the ground of the circuit board 40 into the integral unit, whereby the structure is made simple. Unless this configuration is provided, a circuit element including a conductor like a circuit board, for example, needs to be provided in the vicinity of an outer side of the antenna element. This causes a problem in that the antenna characteristics are affected to be deteriorated by the conductor.

Figure 17A:
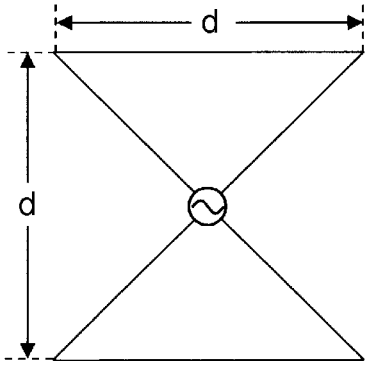
FIGS. 17A to 17C show exemplary drawings depicting examples of a shape of the first conductor element and the second conductor element (antenna elements) of a bow-tie antenna.
Figure 17B:
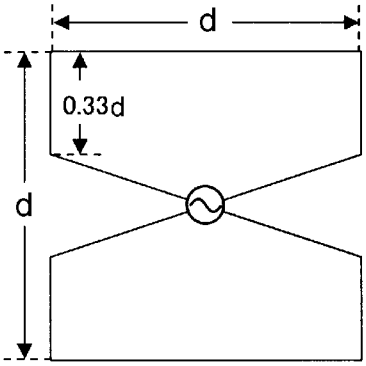
Figure 17C:
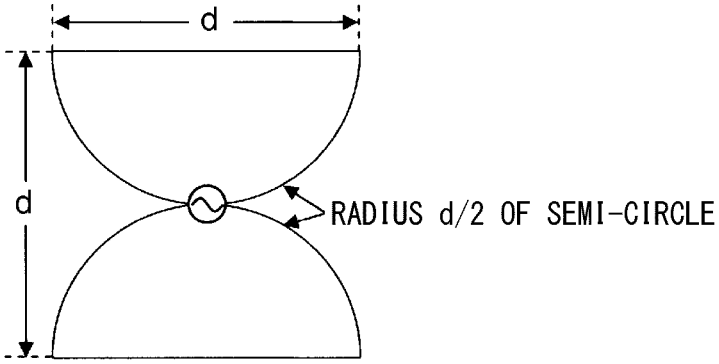

FIGS. 17A to 17C show a basic shape (Shape 1) and modified examples (Shapes 2, 3) of a bow-tie antenna having a pair of conductor elements extending in opposite directions to each other with respect to a feeding point. For the sake of a simple analysis, here, the pair of conductor elements has the same shape (congruence) and are disposed symmetrical with respect to the feeding point.

The shape 1 in FIG. 17A is a triangle in which a feeding point is disposed at a vertex of the triangle. The shape 2 in FIG. 17B has a contour in which two sides of a triangle sandwiching a vertex therebetween are deformed rectilinearly so as to project outwards (in other words, a contour narrows areas of opposite gaps defined between the pair of conductor elements). The shape 3 in FIG. 17C, is a semi-circular conductor element having a curved contour which protrudes towards the feeding point so as to narrow areas of opposite gaps defined between the pair of conductor elements. Further, a semi-elliptic conductor element may also be adopted. As the areas of the opposite gaps defined between the pair of conductor elements get smaller and the capacitance between the pair of conductor elements gets larger, a better band characteristic can be obtained over a wide band.

In addition, in FIGS. 17A to 17C, when increasing the areas of the pair of conductor elements, a drastic fluctuation in impedance characteristics caused by a non-similitude change can be suppressed more easily with a curved contour than with a rectilinear contour when the frequency changes.

Figure 18:
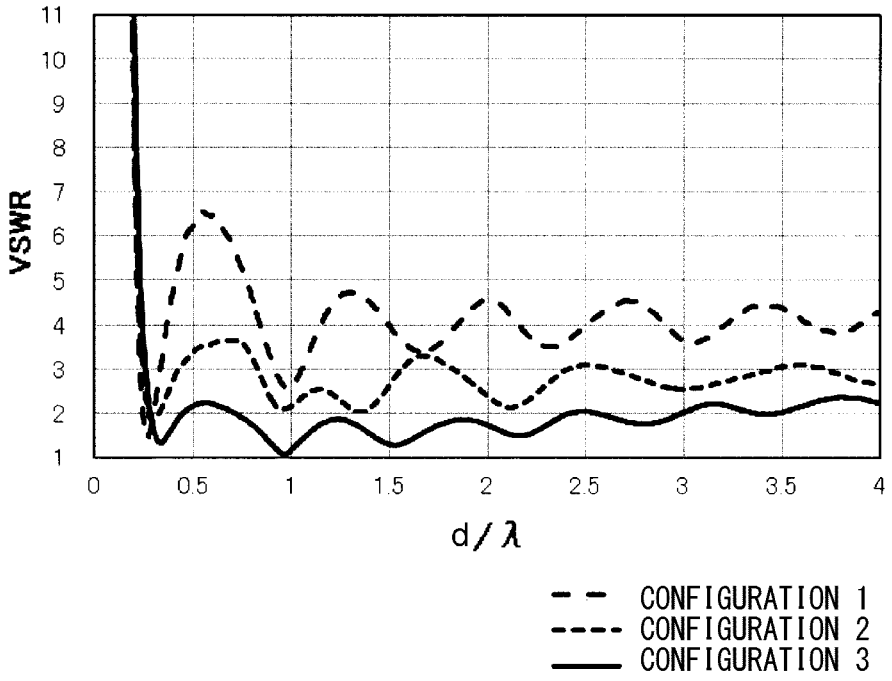
FIG. 18 is a graph showing a relationship between VSWR and d/λ (where, d=a width of each conductor element, λ=a wavelength of TEL radio wave) when using conductor element shapes 1 to 3 shown in FIGS. 17A to 17C as parameters.

FIG. 18 is a graph showing a relationship between VSWR and d/λ (where, d=a width of each conductor element, d/2=a length of each conductor element, λ=a wavelength of TEL radio wave) when using the shapes 1 to 3 as parameters, and it is understood that the VSWR remains lower and more stable with the shape 2 than with the shape 1 and remains further lower and more stable with the shape 3 than with the shape 2. This result is obtained when the coaxial cable of the characteristic impedance of 50Ω is connected.

Figure 19A:
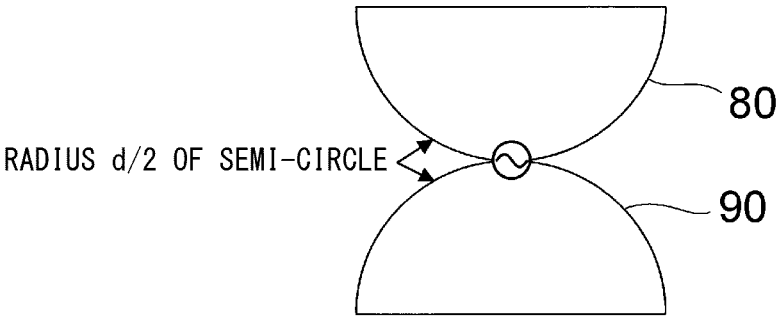
FIGS. 19A to 19C show exemplary drawings depicting other shape examples of the first element and the second conductor element of the bow-tie antenna.
Figure 19B:
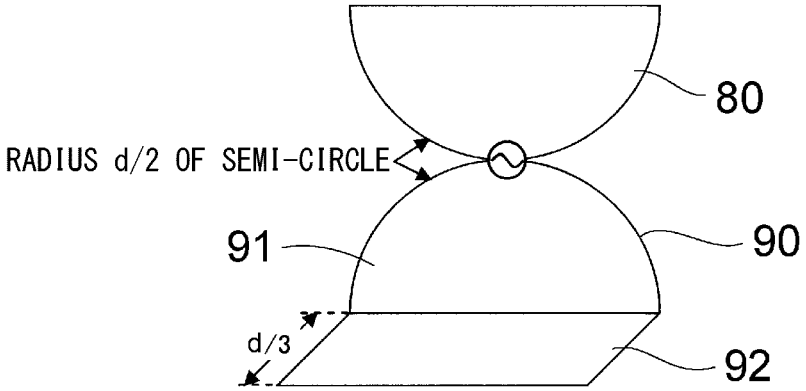
Figure 19C:
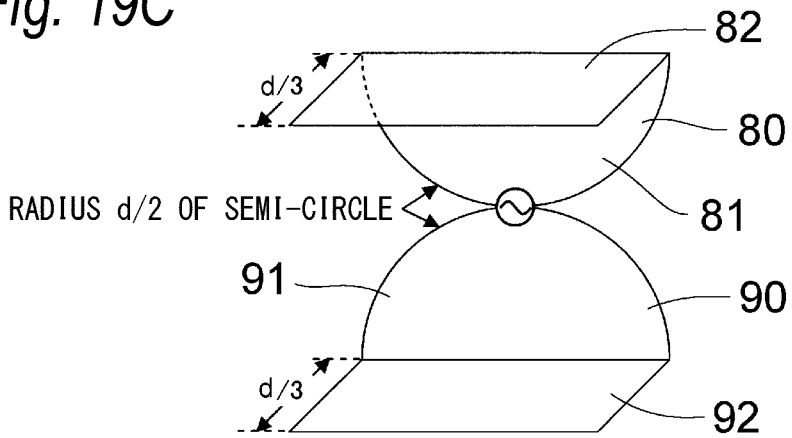

FIGS. 19A to 19C show configurations (Shapes 3-1, 3-2) in which inductance and capacitance are enhanced without increasing a height with respect to the shape 3 which uses the pair of semi-circular conductor elements (the semi-circle of a radius of 2/d), and they can be adopted as conductor elements for the TEL broadband antenna 10 of the first embodiment.

FIG. 19A shows the shape 3 described above, in which the pair of conductor elements 80, 90 disposed opposite to each other with respect to the feeding point have the semi-circular shape. The shape 3-1 shown in FIG. 19B has a configuration that one conductor element 90 has a semi-circular first portion 91 which lies near the feeding point and a second portion 92 which extends from the first portion 91 so as to form an angle substantially equal to 90 degrees or an angle equal to or smaller than 90 degrees. The shape 3-2 in FIG. 19C has a configuration that the other conductor element 80 also has a semi-circular first portion 81 which lies near the feeding point and a second portion 82 which extends from the first portion 81 so as to form an angle of substantially equal to 90 degrees or an angle equal to or smaller than 90 degrees.

Figure 20:
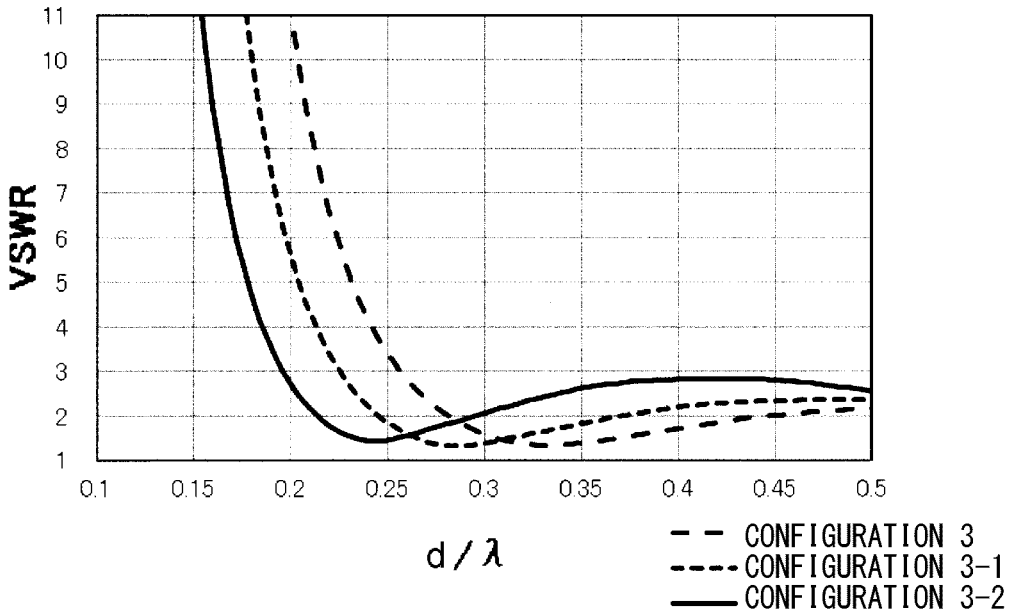
FIG. 20 is a graph showing a relationship between VSWR and d/λ when using the conductor element shapes 3, 3-1 and 3-2 shown in FIGS. 19A to 19C as parameters.

FIG. 20 is a graph showing a relationship between VSWR and d/λ when using the shapes 3, 3-1 and 3-2 as parameters. It is understood that the VSWR remains lower and more stable with the shape 3-1 than with the shape 3 to a low frequency band and remains further lower and more stable with the shape 3-2 than with the shape 3-1 to a lower frequency band. This result is obtained when the coaxial cable of the characteristic impedance of 50Ω is connected.

Figure 21:
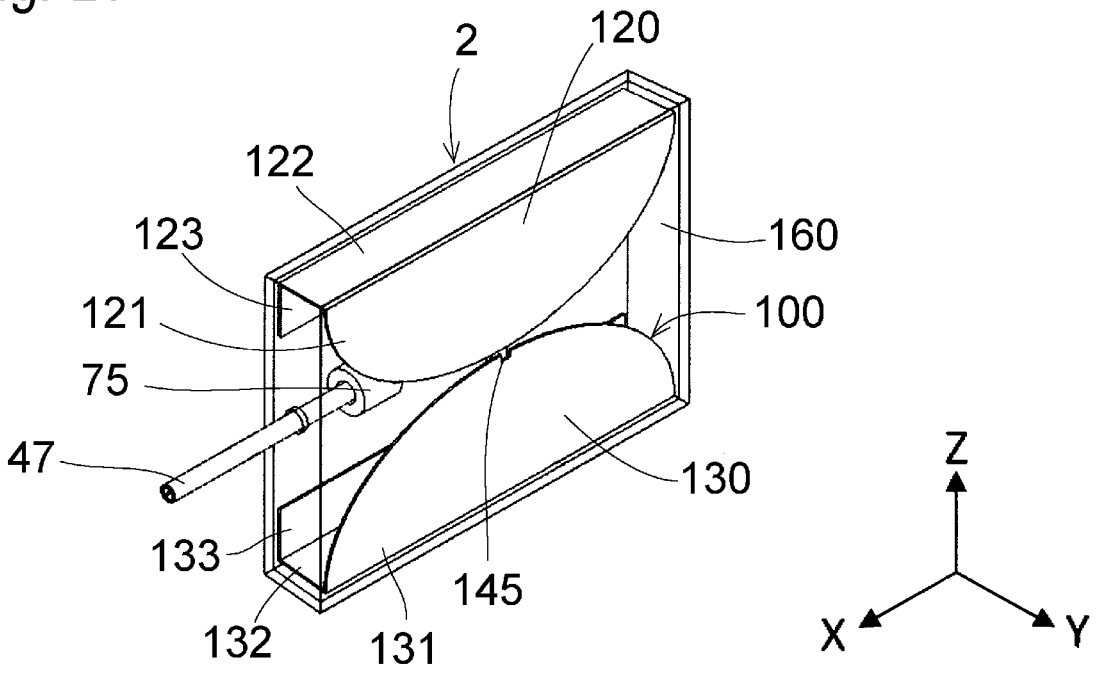
FIG. 21 is a front perspective view of a second embodiment of an antenna device according to the present invention as seen down obliquely from a top view point.
Figure 22:
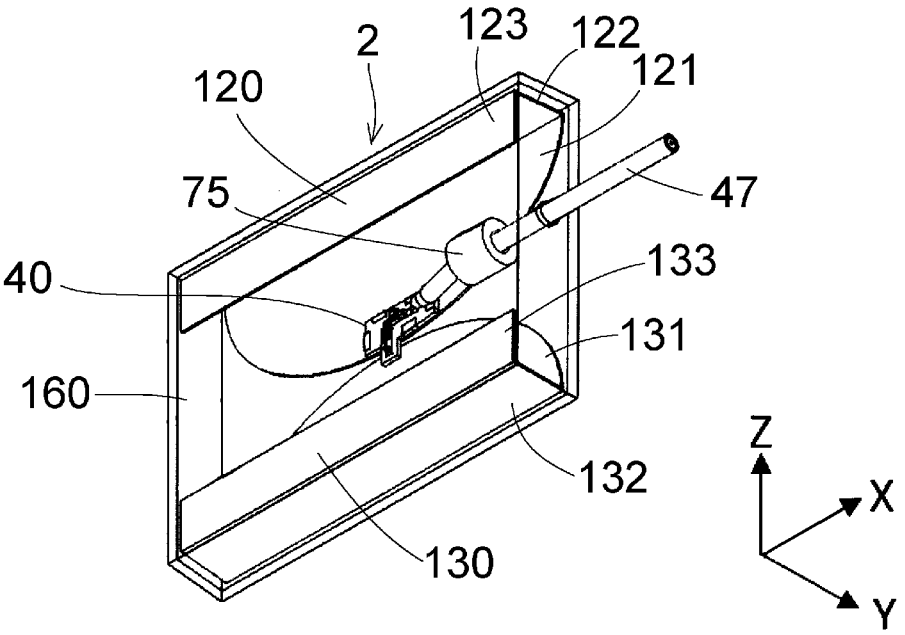
FIG. 22 is a rear perspective view of the same embodiment as seen up from a bottom view point.
Figure 23:
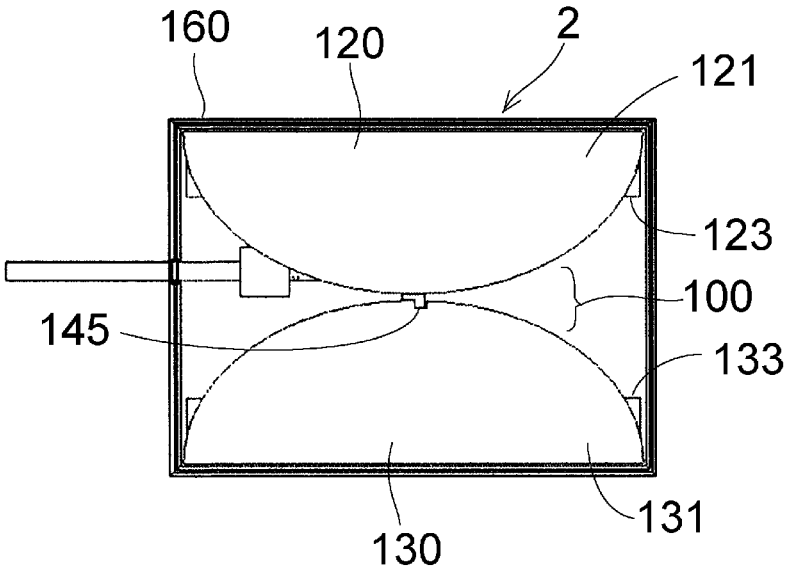
FIG. 23 is a front view of the second embodiment.
Figure 24:
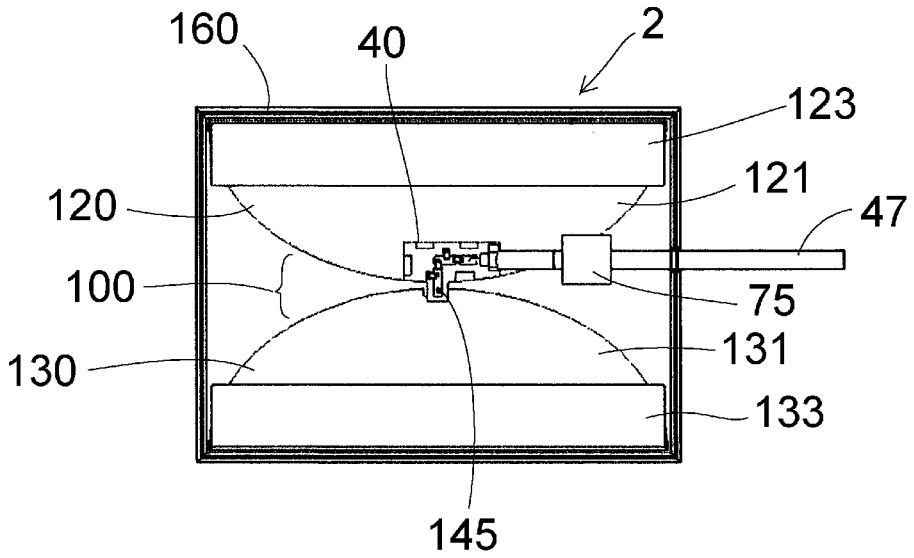
FIG. 24 is a rear view of the same embodiment.
Figure 25:
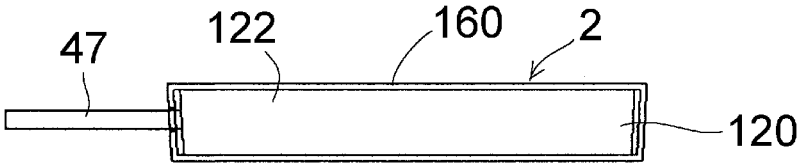
FIG. 25 is a plan view of the same embodiment.
Figure 26:
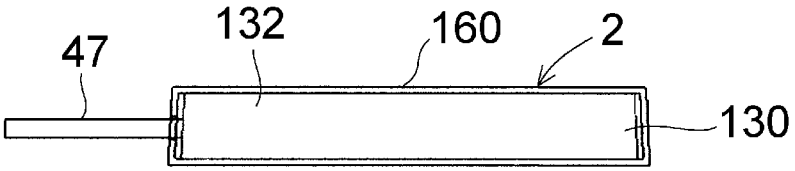
FIG. 26 is a bottom view of the same embodiment.
Figure 27:
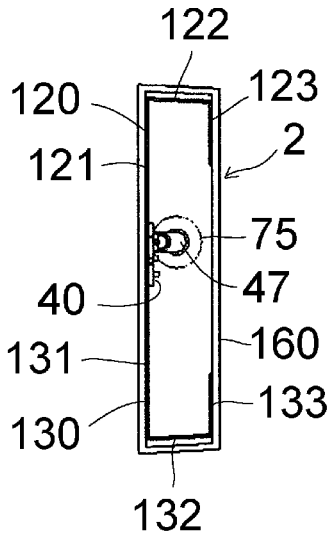
FIG. 27 is a right side view of the same embodiment.
Figure 28:
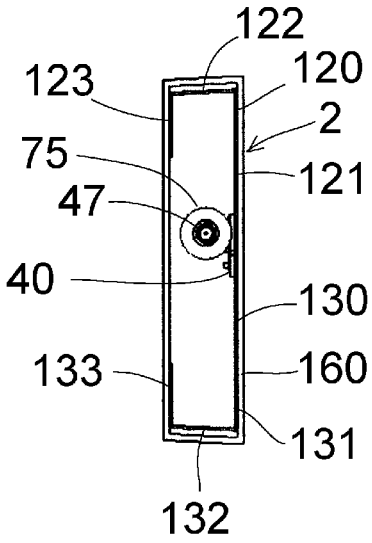
FIG. 28 is a left side view of the same embodiment.
Figure 29A:
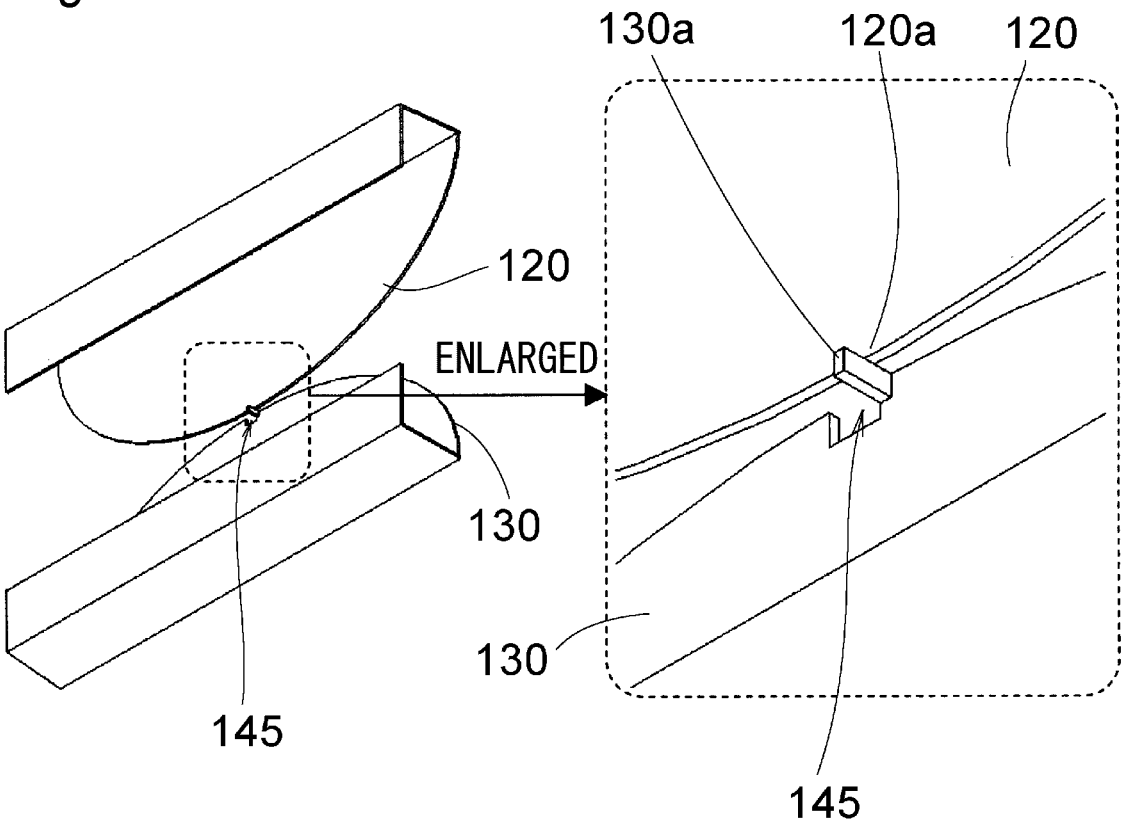
FIG. 29A is a perspective view showing a first plate-like metal and a second plate-like metal of a TEL antenna of the second embodiment, with a portion including a feeding point enlarged.
Figure 29B:
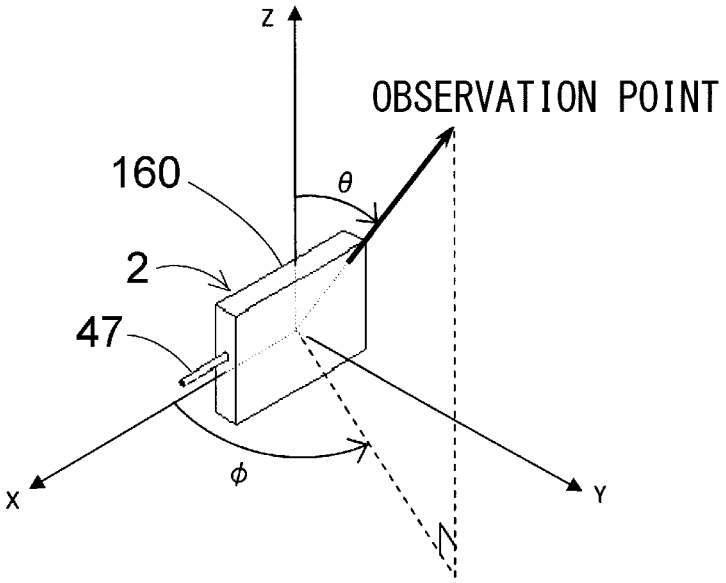
FIG. 29B is an arrangement diagram of the antenna device when measuring antenna gains or the like in the second embodiment.

FIGS. 21 to 28 show a second embodiment of an antenna device according to the present invention, which is an antenna device 2 including a TEL broadband antenna 100 based on a bow-tie antenna. As a matter of convenience in description, as shown in FIGS. 21 and 29B, orthogonal axes, which are an X axis, a Y axis and a Z axis, are defined with respect to the antenna device 2. In addition, in FIG. 29B, the Z axis and an observation point form an angle of θ°. A straight line connecting an origin and an intersection point between a perpendicular drawn down from the observation point to an X-Y plane and the X-Y plane and the X axis form an azimuthal angle 4).

The TEL broadband antenna 100 based on the bow-tie antenna includes a first plate-like metal 120 performing as a first conductor element, a second plate-like metal 130 performing as a second conductor element, and a TEL antenna circuit board 40 (having the same structure as the first embodiment shown in FIG. 9A) performing as a broadband antenna circuit board, and the first plate-like metal 120 and the second plate-like metal 130 extend in opposite directions to each other with respect to a feeding point 145.

The first plate-like metal 120 has a first portion 121, a second portion 122, and further a third portion 123. The first portion 121 extends in a positive Z direction from the feeding point 145, is substantially parallel to an X-Z plane and has a substantially semi-circular or substantially semi-elliptic shape in which the feeding point 145 constitutes its apex. The second portion 122 is bent from the first portion 121 in a negative Y direction so as to be substantially parallel to the X-Y plane and extends in the negative Y direction. The third portion 123 is bent from the second portion 122 in a negative Z direction and extends in the negative Z direction.

The second plate-like metal 130 is constructed symmetrically with the first plate-like metal 120 with respect to the feeding point 145 and has a first portion 131, a second portion 132, and further a third portion 133. The first portion 131 extends in the negative Z direction from the feeding point 145, is substantially parallel to the X-Z plane, and has a substantially semi-circular or substantially semi-elliptic shape in which the feeding point 145 constitutes its apex. The second portion 132 is bent from the first portion 131 in the negative Y direction so as to be substantially parallel to the X-Y plane and extends in the negative Y direction. The third portion 133 is bent from the second portion 132 in the positive Z direction and extends in the positive Z direction.

The first plate-like metal 120 and the second plate-like metal 130 of the TEL broadband antenna 100 are fixed to a radome 160 which is made of resin enabling radio wave to permeate it. The TEL antenna circuit board 40 shown in FIG. 9A is connected to feeding sides of the first plate-like metal 120 and the second plate-like metal 130. The first plate-like metal 120 and the second plate-like metal 130 and the TEL antenna circuit board 40 are accommodated in the radome 160.

The TEL antenna circuit board 40 for impedance matching is shown in FIG. 9A in the first embodiment, and the matching circuit is mounted on the TEL antenna circuit board 40. The TEL broadband antenna 100 and a coaxial cable 47 are connected together via the TEL antenna circuit board 40. That is, the coaxial cable 47 is connected to a feed-side end portion 120*a* of the first plate-like metal 120 and a feed-side end portion 130*a* of the second plate-like metal 130, which are both shown in FIG. 29A, via the matching circuit 41. As is understood from FIGS. 22 and 24, the first plate-like metal 120 of the TEL broadband antenna 100 overlaps the TEL antenna circuit board 40, and the first plate-like metal 120 and a ground of the circuit board 40 are connected together into an integral unit.

A magnetic core 75 (for example, a ferrite core) is provided on an outer circumference of the coaxial cable 47 so as to suppress that a leak current flows to an outer conductor of the coaxial cable 47. The magnetic core 75 is also preferably accommodated in the radome 160.

Figure 30:
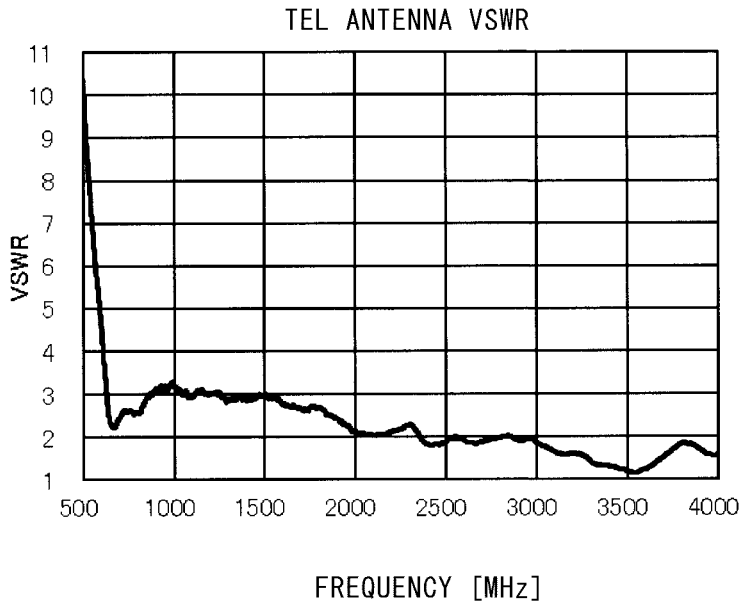
FIG. 30 is a graph showing frequency characteristics of a VSWR, which is antenna characteristics of the TEL antenna in the second embodiment.

FIG. 30 shows frequency characteristics of a VSWR of the TEL broadband antenna 100 based on the bow-tie antenna according to the second embodiment, and a sufficiently low VSWR can be realized over a broad frequency band of the LTE. This result is obtained in a condition that the coaxial cable of the characteristic impedance of 50Ω is connected.

Figure 31:
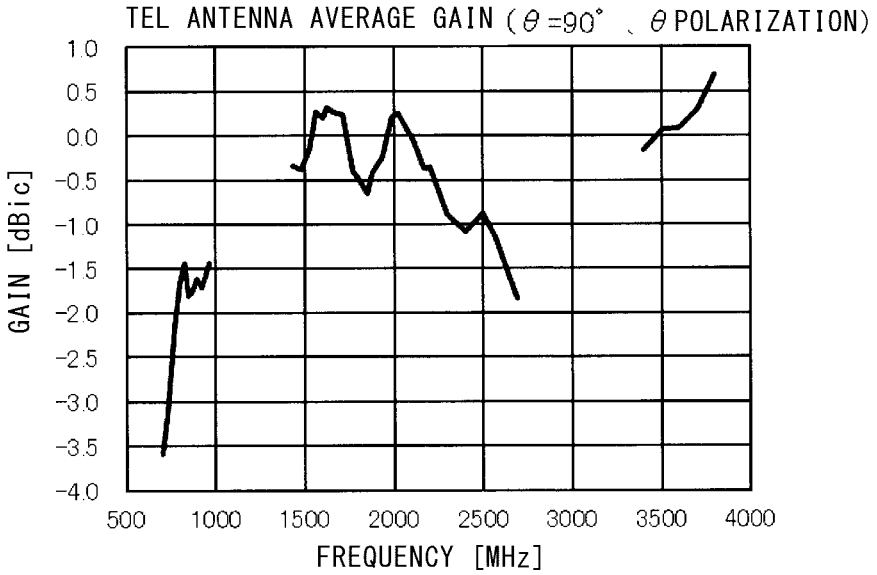
FIG. 31 is a graph showing frequency characteristics of an average gain (dBic) of θ polarization (vertical polarization) at θ=90° (horizontal plane), which is antenna characteristics of the TEL antenna in the second embodiment.

When the antenna device 2 of the second embodiment is disposed as shown in FIG. 29B and the positive Z direction of the Z axis is referred to as the zenith direction, the TEL broadband antenna 100 has a high average gain of θ polarization at θ=90° (horizontal plane) as shown in FIG. 31. The gain deviation becomes small at the azimuthal angle ϕ.

FIG. 31 shows frequency characteristics of the average gain (dBic) of θ polarization (vertical polarization) at θ=90° (horizontal plane) of the TEL broadband antenna 100, and a sufficient average gain can be ensured over the frequency band of the LTE. In addition, the average gain (dBic) is an average value of the gain when the azimuthal angle ϕ shown in FIG. 29B is changed from 0° to 360°.

According to the configuration of the antenna device 2 described in the second embodiment, the first portions 121, 131 of the first plate-like metal 120 and the second plate-like metal 130 which extend in the opposite directions with respect to the feeding point 145 have the substantially semi-circular or substantially semi-elliptic shape having the curved contour protruding towards the feeding point 145. Further, the second portions 122, 132 and the third portions 123, 133 which are bent from the first portions 121, 131 are provided. This configuration can increase capacitance and inductance to realize an improvement in characteristics in a lower frequency band, whereby the external shape of the antenna device 2 can be lowered in height.

Thus, while the present invention has been described heretofore by reference to the embodiments, it is understandable to those skilled in the art to which the invention pertains that various modifications can be made to the constituent elements or the treatment processes of the embodiments without departing from the scope of claims. Hereinafter, modified examples will briefly be described.

When the antenna device of each embodiment is mounted on a vehicle, it is normal that the antenna device is disposed so that the X-Y plane shown in FIGS. 1, 11 and 29B becomes horizontal and the positive Z direction of the Z axis is directed towards the zenith. However, the present invention is not limited to such an antenna arrangement, and hence, the arrangement of the antenna device can be changed according to applications.

In each of the embodiments, in the plate-like metals which perform as the conductor elements of the broadband antenna based on the bow-tie antenna, the second portion is formed by being bent from the first portion as an example. However, the second portion may be curved from the first portion. Also in the second embodiment, there will be no problem even when the third portion is curved from the second portion.

In the first embodiment, the main parts of the conductor elements of the broadband antenna 10 based on the bow-tie antenna are disposed along the Z axis, and the patch antenna 50 is disposed on the plane which is substantially at right angles to the Z axis. However, the broadband antenna 10 and the patch antenna 50 may both be disposed at an arbitrary setting angle.

In the second embodiment, the first plate-like metal 120 and the second plate-like metal 130 have substantially the same shape. However, one of the plate-like metals may have such a shape which is the shapes 1 to 3 shown in FIGS. 17A to 17C without an extending portion for example.

The circuit configurations of the TEL antenna circuit board and the GNSS antenna circuit board in each of the embodiments are described as examples and hence can be modified as required.

DESCRIPTION OF REFERENCE NUMERALS

1 composite antenna device
2 antenna device
10, 100 TEL broadband antenna
20, 120 first plate-like metal
21, 121, 131 first portion
22, 122, 132 second portion
23, 24 rib
23*a*, 24*a* cutaway
30, 130 second plate-like metal
40 TEL antenna circuit board
41 matching circuit
45, 145 feeding point
47, 57 coaxial cable
50 patch antenna
51 patch antenna element
55 GNSS antenna circuit board
60, 160 radome
70 shield case

The invention claimed is:

1. A composite antenna device comprising:

a broadband antenna based on a bow-tie antenna including a first conductor element and a second conductor element that extend in opposite directions to each other with respect to a feeding point;

a patch antenna provided on the first conductor element or the second conductor element;

a coaxial cable that feeds the patch antenna;

another coaxial cable that feeds the broadband antenna; and a magnetic core that is provided at an outer circumference of each of the coaxial cable and the other coaxial cable.

2. The composite antenna device according to claim 1, wherein the first conductor element or the second conductor element performs as a ground of the patch antenna.

3. The composite antenna device according to claim 1, wherein when orthogonal three axes are referred to as an X axis, a Y axis and a Z axis, the first conductor element includes a portion extending in a positive Z direction from the feeding point and being substantially parallel to an X-Z plane, and the second conductor element includes a portion extending in a negative Z direction from the feeding point and being substantially parallel to the X-Z plane, and at least one of the first conductor element and the second conductor element includes a first portion lying near the feeding point and a second portion extending from the first portion so as to have an area being non-parallel to the first portion.

4. The composite antenna device according to claim 3, wherein the second portion extends from the first portion so as to be substantially parallel to an X-Y plane or to form an angle equal to or smaller than 90 degrees between the first portion and the second portion.

5. The composite antenna device according to claim 1, wherein when orthogonal three axes are referred to as an X axis, a Y axis and a Z axis, the first conductor element includes a first portion lying near the feeding point, the first portion extending in the positive Z direction from the feeding point and being substantially parallel to the X-Z plane, and a second portion extending in substantially parallel to the X-Y plane from the first portion, and the patch antenna is provided on the second portion of the first conductor element.

6. The composite antenna device according to claim 5, comprising:

ribs formed in both side positions of the patch antenna so as to rise in the positive Z direction from the second portion of the first conductor element, wherein a cutaway is provided at portions of the ribs opposing both side surfaces of the patch antenna.

7. The composite antenna device according to claim 1, wherein at least one of the first conductor element and the second conductor element has a curved contour projecting towards the feeding point so as to narrow areas of opposite gaps defined between the first conductor element and the second conductor element.

8. The composite antenna device according to claim 1, wherein a broadband antenna circuit board is interposed between the broadband antenna and the other coaxial cable, and a ground of the broadband antenna circuit board is overlapped on the first conductor element to be integrally connected with the first conductor element.

9. The antenna device according to claim 1, wherein an antenna based on the bow-tie antenna is a telematics antenna, and the patch antenna is an antenna for receiving a satellite wave.

10. An antenna device comprising:

a broadband antenna based on a bow-tie antenna including a first conductor element and a second conductor element that extend in opposite directions with respect to a feeding point, wherein at least one of the first conductor element and the second conductor element has a curved contour projecting towards the feeding point so as to narrow areas of opposite gaps defined between the first conductor element and the second conductor element, wherein a broadband antenna circuit board is interposed between the broadband antenna and a coaxial cable that feeds the broadband antenna, and wherein the antenna device further comprises:

a magnetic core that is provided at an outer circumference of each of the coaxial cable and another coaxial cable that feeds a patch antenna.

11. The antenna device according to claim 10, wherein when orthogonal three axes are referred to as an X axis, a Y axis and a Z axis, the first conductor element includes a portion extending in a positive Z direction from the feeding point and being substantially parallel to an X-Z plane, and the second conductor element includes a portion extending in a negative Z direction from the feeding point and being substantially parallel to the X-Z plane, and at least one of the first conductor element and the second conductor element includes a first portion lying near the feeding point and a second portion extending from the first portion so as to have an area being non-parallel to the first portion.

12. The antenna device according to claim 11, wherein the second portion extends from the first portion so as to be substantially parallel to an X-Y plane or to form an angle equal to or smaller than 90 degrees between the first portion and the second portion.

13. The antenna device according to claim 11, comprising a third portion extending from the second portion so as to have an area being non-parallel to the second portion.

14. The antenna device according to claim 10, wherein a ground of the broadband antenna circuit board is overlapped on the first conductor element or the second conductor element so as to integrally connected with the first conductor element or the second conductor element.

15. A composite antenna device comprising:

a broadband antenna based on a bow-tie antenna including a first conductor element and a second conductor element that extend in opposite directions to each other with respect to a feeding point;

a patch antenna provided on the first conductor element or the second conductor element;

a first coaxial cable that feeds the broadband antenna;

a second coaxial cable that feeds the patch antenna; and a magnetic core that is provided at an outer circumference of each of the first coaxial cable and the second coaxial cable.

* * * * *